US006025042A

United States Patent [19]

Kligman et al.

[11] Patent Number: 6,025,042

[45] Date of Patent: Feb. 15, 2000

[54] ARTIFICIAL AQUATIC PLANTS

[76] Inventors: Alan L. Kligman, 327 Southwinds Dr., Forked River, N.J. 08731; Richard J. Schaller, 1170 Hillview Rd., Allentown, Pa. 18103

[21] Appl. No.: 09/172,027

[22] Filed: Oct. 14, 1998

[51] Int. Cl.[7] ..... A41G 1/00

[52] U.S. Cl. ..... 428/24; 428/26

[58] Field of Search ..... 428/24, 26; 119/253

[56] References Cited

U.S. PATENT DOCUMENTS

| | | | |
|---|---|---|---|
| 2,879,617 | 3/1959 | Popeil | 41/13 |
| 2,908,942 | 10/1959 | Bosco | 18/59 |
| 4,215,163 | 7/1980 | Lee | 428/24 |
| 4,588,618 | 5/1986 | Wolfe | 428/7 |
| 4,957,787 | 9/1990 | Reinhardt et al. | 428/24 |

*Primary Examiner*—Alexander Thomas
*Attorney, Agent, or Firm*—Richard C. Litman

[57] ABSTRACT

An artificial lily pad is made with polyester fabric flower petals, molded polypropylene or polyethylene stamens and stigmata, ethylene vinyl acetate leaves, polystyrene foam pads, and a bottom anchor ring. An anchor weight is attached to the bottom anchor ring by a monofilament nylon line.

13 Claims, 3 Drawing Sheets

ARTIFICIAL AQUATIC PLANTS

BACKGROUND OF THE INVENTION

1. Field of the Invention

The present invention relates to at least one artificial aquatic plant on a leaf pad, the aquatic plant being suspended above the water level by at least one float pad able to be anchored to the bottom of a pond or the like.

2. Description of the Related Art

The related art of interest describes various flowers and their methods of manufacture. The related art will be discussed in the order of perceived relevance to the present invention.

U.S. Pat. No. 4,588,618 issued on May 13, 1986, to Henry S. Wolfe describes an artificial water lily pad ornament for a swimming pool holding a candle. From the edges of a hollow plastic lily pad leaf, several large fish are each hung by two monofilament lines. Smaller fish are suspended by vertical posts from the interior portion of the leaf. A frog is added on the leaf. An anchor is tied to the leaf by a line. The water lily pad ornament is distinguished by its hollow lily pad leaf, candle, frog and numerous suspended fish.

U.S. Pat. No. 4,215,163 issued on Jul. 29, 1980, to Bobby L. Lee describes artificial flowers and a method for their manufacture. A rose, for example, can be made from artificial silk petals and plastic stamens attached to a molded polyvinyl chloride calyx, stem and petioles with wire inserts. The leaves are made from either fabric or plastic and secured to the petioles by glue. These flowers are distinguishable by their susceptibility to damage by water immersion.

U.S. Pat. No. 4,957,787 issued on Sep. 18, 1990, to Linda P. Reinhardt et al. describes an artificial rose, wherein the petals are made from a stretched matrix of porous polyethylene and/or polypropylene and silica with added colorant and perfume. The glued and wired artificial flower with a plastic calyx, fabric leaves, and taped stem is distinguishable for its non-resistance to immersion in water.

U.S. Pat. No. 2,908,942 issued on Oct. 20, 1959, to Lino Bosco describes a process of manufacturing plastic flowers and leaves in a multicolor design. The process involves the removal of parts of the molded piece to add another colored plastic. The plastic can be polyethylene or polystyrene. The process is limited to the production of colored plastic flowers and leaves.

U.S. Pat. No. 2,879,617 issued on Mar. 31, 1959, to Samuel J. Popeil describes a method for manufacturing artificial leaves, flowers, and plants from a heat cured, vinyl base, pigmented liquid "Plastisol" in black anodized aluminum molds. The stems are formed from cotton-wrapped wires. While the leaves are still hot, the stripped leaves are twisted to impart a natural appearance. The plants are distinguished by their lack of resistance to contact with water.

None of the above inventions and patents, taken either singularly or in combination, is seen to describe the instant invention as claimed. Thus, an artificial floating aquatic plant with the advantages of a higher degree of flotation produced by a floating pad placed under each leaf pad for increased drainage of water from the aquatic plant and the use in ponds, aquariums, fountains, and swimming pools and the like is desired.

SUMMARY OF THE INVENTION

The invention is directed to an economical, versatile artificial water plant for use in ponds, aquariums, fountains, swimming pools, and home or commercial displays. An artificial lily or other colorful flowers such as hyacinth can be positioned on an artificial leaf or leaves which can be supported by at least one artificial floating pad. An anchor tied to the water plant by a line prevents excessive movement. The advantages of using an artificial water plant are replacement of live plants indoors or outdoors, colorful, lifelike, providing shade for fish reducing stress, not requiring sunlight or nutrients, ever-blooming year-round, reducing algae blooms, and functional in distributing mosquito repellents.

Accordingly, it is a principal object of the invention to provide a versatile floating artificial aquatic plant for use in ponds, aquariums, fountains, swimming pools, and the like.

It is another object of the invention to provide an artificial floating aquatic plant having a higher degree of flotation for increased drainage of water from the plant.

It is a further object of the invention to provide a colorful floating aquatic plant with multiple flowers and flotation pads at different levels.

Still another object of the invention is to provide an aquatic plant which provides advantages in offering shade for fish, preventing excessive algae blooms, and support for mosquito repellents.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
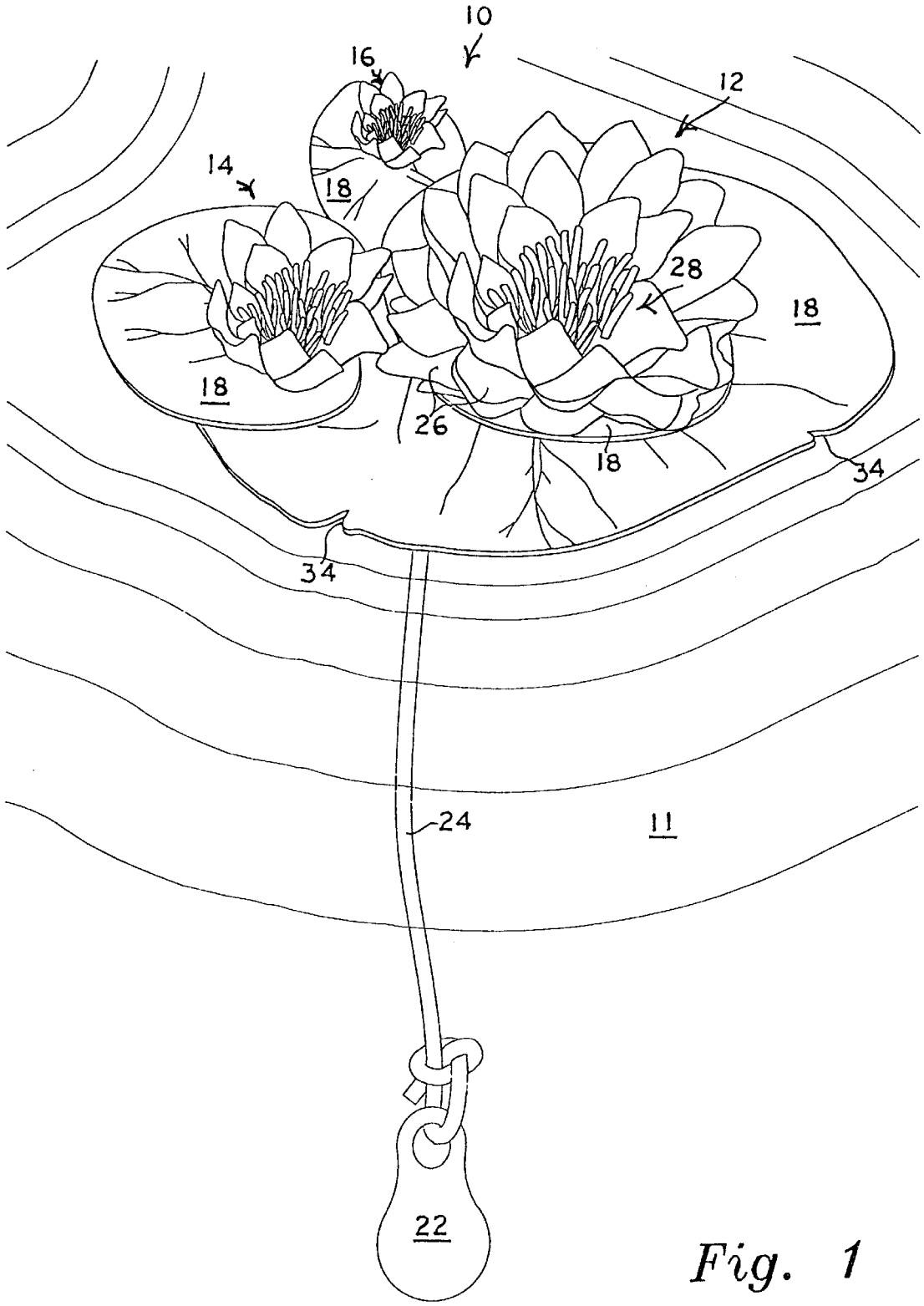
FIG. 1 is an environmental, perspective view of a first embodiment of an anchored artificial aquatic plant, e.g., a lily pad, with multiple flowers according to the present invention.
Figure 2:
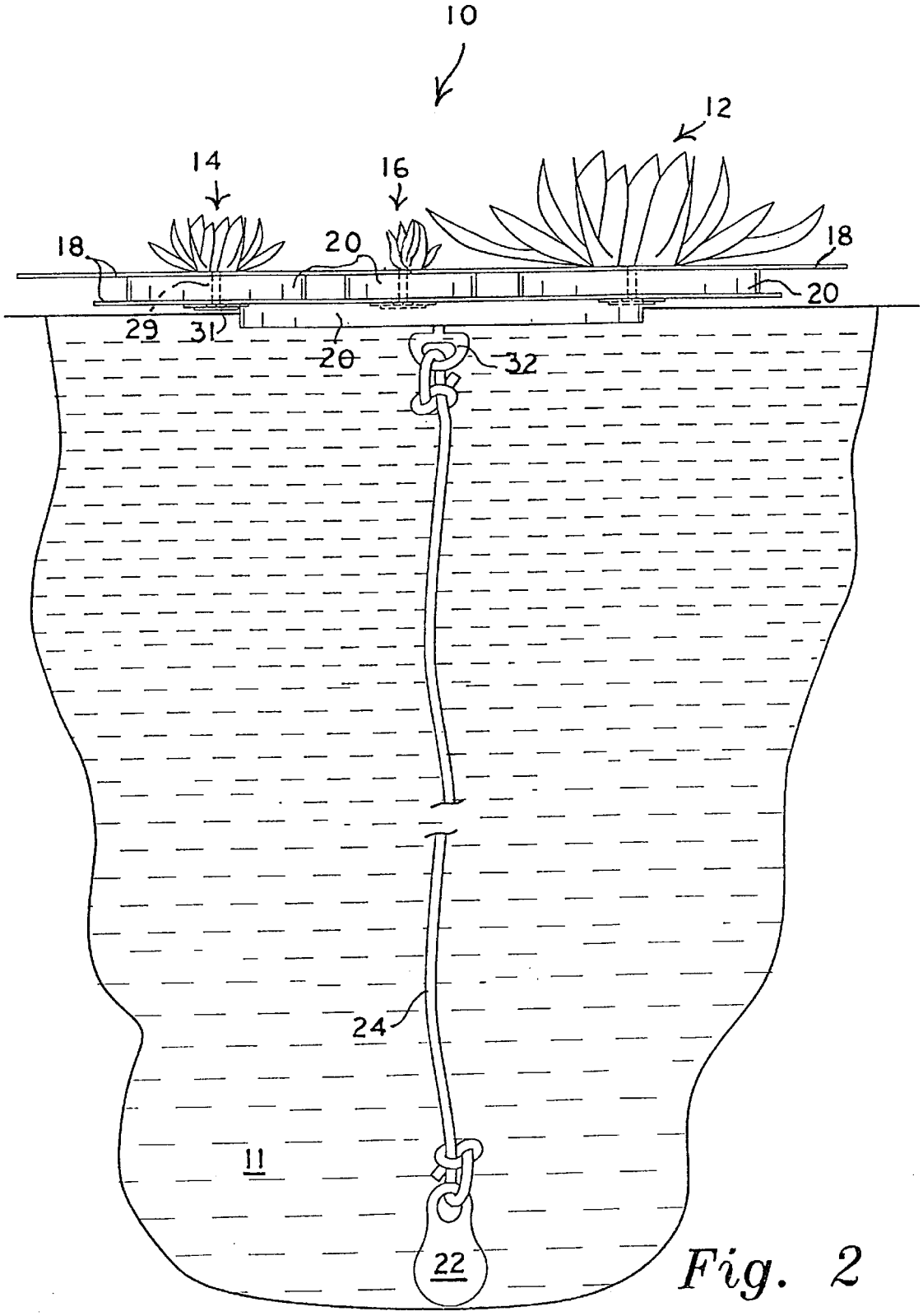
FIG. 2 is a side elevational view of the FIG. 1 embodiment.

The present invention depicted in FIGS. 1 and 2 illustrates the first embodiment of a multiple flowered lily pad device 10 in water 11 with the largest size lily 12, the intermediate size lily 14, and the smallest size lily 16 positioned on individual lily pads or leaves 18. The circular shaped pads or leaves 18 are supported by individual flotation pads 20 (FIG. 2) which vary in size according to the size of the flower and leaves being supported. An anchor 22 as a weight is tied to the lily pad device 10 by a monofilament nylon line 24 which is colorless in water.

The lily petals 26 are usually arranged in a ring with the largest petals grouped on the outside in rings of petals but decreasing in length from the outside. Smaller rings with the same colored smaller petals decreasing in size complete the petal structure. The lily petals 26 can be white or colored such as red, yellow, and pink. In FIGS. 1 and 2, the petals 26 are off-white with pink tips (not shown). The petals 26 are made from polyester fabric and curved inward to present a life-like appearance.

Figure 3:
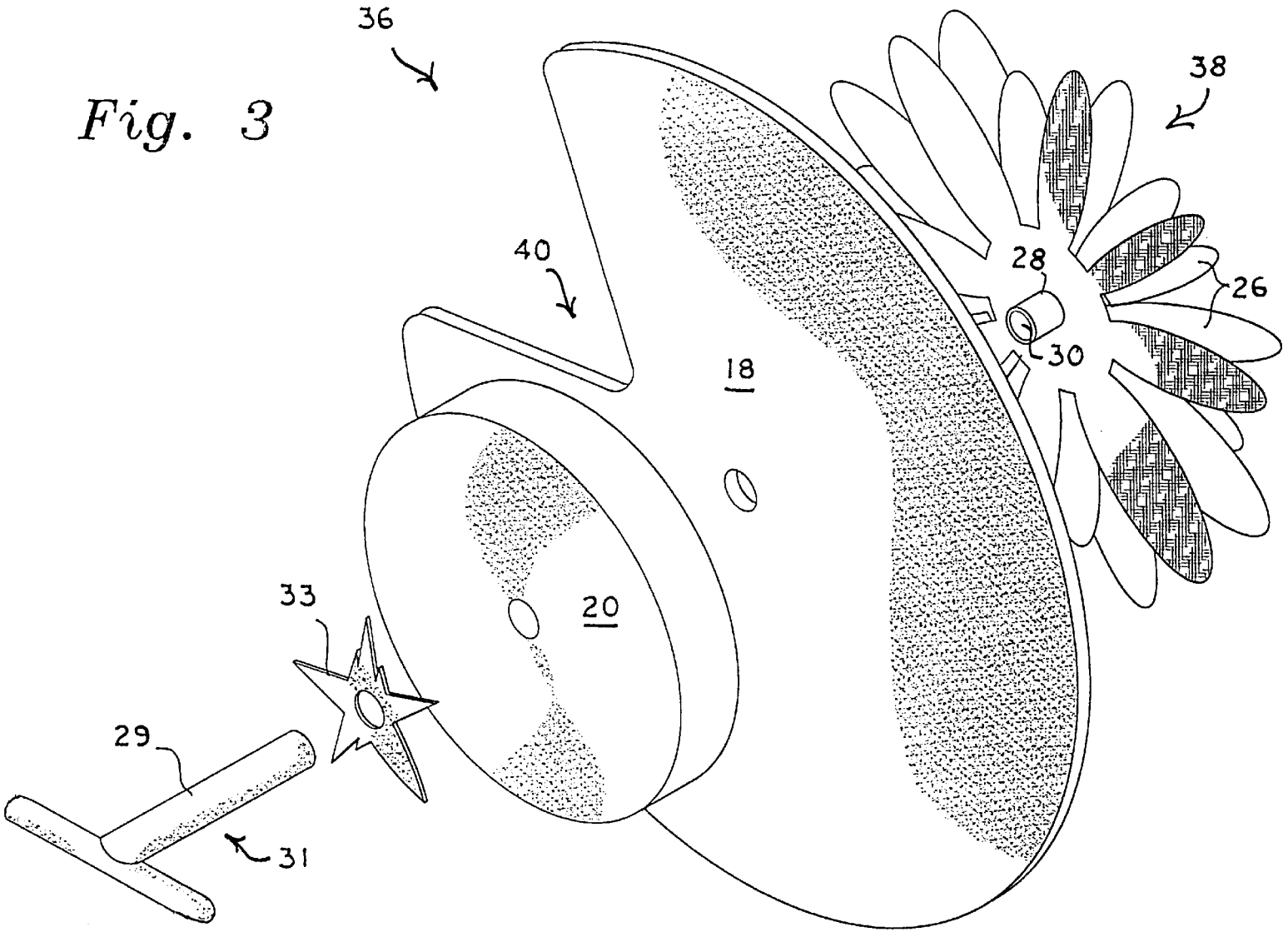
FIG. 3 is an exploded view of a second embodiment of a single flowered aquatic plant, e.g., a lily pad.

The plastic preformed stamens and short stigmata 28 are preferably yellow and molded polyethylene or polypropylene. A stamen-stigmata group 28 has a hollow stem 30 (FIG. 3) which penetrates the center of the flower, each leaf 18 and its flotation pad 20 to engage the stem 29 of a plastic T-shaped holder 31, i.e., the stem 29 fits frictionally into the hollow stem 30. A green plastic leaf-like washer 33 helps support the leaf 18 against the remaining parts of each flower in the aquatic plant 10 or 36 (FIG. 3).

In FIGS. 1 and 2, the largest bottom flotation pad 20 is anchored at its center to a green plastic D-ring holder 32 made from polypropylene or polyethylene. The nylon anchor line 24 is then tied to the holder 32.

The leaves 18 are formed from a flexible thin layer of ethylene vinyl acetate which is water repellent and silk-screen painted green with lighter vein structure to appear natural. The leaves 18 have a main indentation (not shown) and small indentations 34 on its periphery.

The flotation pads 20 are made from polystyrene foam and painted green. The circular, rectangular or oval flotation pads 20 vary in shape, thickness and size according to the weight of the flower and leaf 18 being supported. The object is to maintain the water lily device 10, 36 as high in the water as possible to shed any water splashed on it.

The second embodiment of a single water lily device 36 is illustrated in an exploded version in FIG. 3 to better show the individual parts. The lily petals 26 with its stamens and short stigmata 28 are positioned on the lily pad or leaf 18 (having a main indentation 40) and its underlying flotation pad 20 by inserting the stem 29 having a leaf-shaped washer 33 on it into the hollow stem 30 of the D or T-shaped holder 31. This arrangement provides a secure and attractive floating aquatic plant.

Thus, an economical, useful, attractive floating water plant device has been presented which can be exhibited in a home, a business establishment, a swimming pool, a pond, a fountain, and the like.

It is to be understood that the present invention is not limited to the embodiments described above, but encompasses any and all embodiments within the scope of the following claims.

We claim:

1. An artificial floating flower pad device for display on an aqueous medium comprising:

an artificial flower containing a plurality of colored petals surrounding a group of differently colored stamens and stigmata having an anchoring stem;

a circular, green colored and veined leaf which is shaped with a large indentation and small peripheral indentations;

a floating element;

a D-shaped anchor element;

said hollow anchoring stem adapted to connect said flower, petal, stamens and stigmata to said D-shaped anchor element through said leaf and said floating element to form a floating flower pad device; and an anchor connected by a line to said hollow anchoring stem of said floating flower pad device.

2. The artificial floating flower pad device according to claim 1, wherein the artificial floating flower pad device is a lily pad.

3. The artificial floating flower pad device according to claim 1, including a leaf-like washer for aiding the securement of the stamens and stigmata to the D-shaped anchor element.

4. The artificial floating flower pad device according to claim 1, including D or T-shaped holder element for securing the parts of the flower.

5. The artificial floating flower pad device according to claim 4, including a leaf-like washer for aiding the securement of the stamens and stigmata to D or t-shaped holder element.

6. The artificial floating flower pad device according to claim 1, including several flowers on individual leaves and floating elements are coupled together, and attached to an additional lowermost circular floating element.

7. The artificial floating flower pad device according to claim 6, wherein the artificial floating flower display device is a multiple flowered lily pad.

8. The artificial floating flower pad device according to claim 1, wherein the outside petals are arranged in sets of petals decreasing in length from the outside.

9. The artificial floating flower pad device according to claim 8, wherein smaller petals in smaller rings complete the petal structure.

10. The artificial floating flower pad device according to claim 1, wherein the petals are made of polyester fabric and curved inward.

11. The artificial floating flower pad device according to claim 1, wherein the stamens and stigmata are molded and made of a plastic selected from the group consisting of polyethylene and polypropylene.

12. The artificial floating flower pad device according to claim 1, wherein the leaves are formed from a flexible thin layer of ethylene vinyl acetate and colored green with veins by silk-screening.

13. The artificial floating flower pad device according to claim 1, wherein the flotation pads are made from polystyrene foam and painted green.

* * * * *